US006755682B2

(12) United States Patent
Kunishi et al.

(10) Patent No.: US 6,755,682 B2
(45) Date of Patent: Jun. 29, 2004

(54) ROTATING ACTUATOR FOR CABLE CONNECTOR WITH HOOK SHAPED PIVOT ON TERMINAL

(75) Inventors: Shinsuke Kunishi, Kanagawa (JP); Hideki Iijima, Yamato (JP); Kouji Murakami, Sagamihara (JP)

(73) Assignee: Molex Incorporated, Lisle, IL (US)

( * ) Notice: Subject to any disclaimer, the term of this patent is extended or adjusted under 35 U.S.C. 154(b) by 57 days.

(21) Appl. No.: 10/293,693

(22) Filed: Nov. 13, 2002

(65) Prior Publication Data

US 2003/0092310 A1 May 15, 2003

(30) Foreign Application Priority Data

Nov. 13, 2001 (JP) ..... 2001-347597

(51) Int. Cl.[7] ..... H01R 12/24; H01R 13/62
(52) U.S. Cl. ..... 439/495; 439/260
(58) Field of Search ..... 439/495, 260

(56) References Cited

U.S. PATENT DOCUMENTS

| | | | | |
|---|---|---|---|---|
| 5,173,058 A | | 12/1992 | Broeksteeg et al. | 439/267 |
| 5,458,506 A | | 10/1995 | Yamaguchi et al. | 439/495 |
| 5,580,272 A | | 12/1996 | Yamaguchi et al. | 439/495 |
| 5,738,545 A | | 4/1998 | Igarashi et al. | 439/607 |
| 5,785,549 A | | 7/1998 | Takayasu | 439/495 |
| 5,839,917 A | | 11/1998 | Takahashi et al. | 439/495 |
| 5,842,883 A | | 12/1998 | Igarashi et al. | 439/495 |
| 5,904,586 A | | 5/1999 | Takayasu | 439/260 |
| 5,906,498 A | | 5/1999 | Nagafuji | 439/260 |
| 6,056,571 A | * | 5/2000 | Noro | 439/260 |
| 6,056,572 A | | 5/2000 | Matsumoto et al. | 439/260 |
| 6,089,905 A | | 7/2000 | Shimmyo et al. | 439/495 |
| 6,099,346 A | | 8/2000 | Hashiguchi et al. | 439/495 |
| 6,116,947 A | | 9/2000 | Takayasu | 439/495 |
| 6,203,345 B1 | | 3/2001 | Roque et al. | 439/260 |
| 6,206,723 B1 | * | 3/2001 | Kunishi | 439/495 |
| 6,332,801 B1 | | 12/2001 | Watanabe | 439/409 |
| 6,338,648 B1 | | 1/2002 | Miura et al. | 439/495 |
| 6,383,017 B1 | | 5/2002 | Takayasu | 439/495 |
| 6,431,897 B1 | | 8/2002 | Hashiguchi et al. | 439/267 |
| 6,471,541 B2 | * | 10/2002 | Kunishi et al. | 439/495 |

* cited by examiner

*Primary Examiner*—Chandrika Prasad
(74) *Attorney, Agent, or Firm*—Stephen Z. Weiss

(57) ABSTRACT

An FPC connector has a structure not damaging contacts of terminals upon assembling. In the FPC connector, each of the terminals has a contact beam extending into the FPC inserting portion and a pivot beam extending substantially parallel in upper side of the contact beam, and a cut-out portion is formed on a lower edge at a tip end portion of the pivot beam for forming a pivot portion of the actuator. The actuator is formed with through openings corresponding to pivot portions of respective terminals, a peripheral edge portion of each of the through hole being formed into a cross-sectionally substantially circular shape shaft portion to engage with the pivot portion. Pushing projecting portions is provided between adjacent shaft portions for pivoting according to pivot motion of the actuator for urging the FPC toward the contacts of the terminals.

4 Claims, 6 Drawing Sheets

PRIOR ART

ROTATING ACTUATOR FOR CABLE CONNECTOR WITH HOOK SHAPED PIVOT ON TERMINAL

FIELD OF THE INVENTION

The present invention relates to a connector for flat flexible cable, which is typically referred to as FPC (flat printed circuit or cable), FFC (flat flexible cable) and so forth. All of these cables and circuits will be generally referred to as "FPC".

DESCRIPTION OF THE RELATED ART

A conventional FPC connector generally includes an insulative housing formed with an FPC inserting portion, a plurality of terminals loaded in parallel relationship with a predetermined pitch in the insulative housing, and a pivoting actuator for establishing electrical contact between the conductors of the FPC and terminals of the connector.

There has been proposed in the prior art a structure for pivotably supporting the actuator, in which a pivot beam 101 is provided in a terminal, a pivot portion 102 is formed at a tip end portion of the pivot beam 101 to engage with a cam portion 104 of an actuator 103 as shown in FIGS. 13 and 14 (Japanese Unexamined Patent Publication Nos. 2000-106238 and 2001-76794, for example). Namely, on a side edge portion of the actuator 103, a through opening 105 is formed corresponding to the pivot portion 101 of the terminal 100. A peripheral edge portion of the through opening 105 is formed as a cam portion 104 of sectional shape as shown. The cam portion 104 is engaged with the pivot portion 102 of the terminal. Accordingly, the cam portion 104 engages with the pivot portion 101 above a contact beam 106 of the terminal 100.

Upon assembling such actuator 103 to an insulative housing 107 loaded terminals 100, the actuator 103 is situated at substantially perpendicular position relative to the insulator housing 107. Then, the actuator 103 is moved from front side (left side in the drawings) to rear side with maintaining attitude relative to the insulative housing 107 with accommodating the pivot portions 101 of the terminals 100 through the through openings 105. Therefore, dimension of the through opening (A in FIG. 13) becomes greater relative to a dimension in height direction (B in FIG. 13) of the pivot portion 101 of the terminal 100 to facilitate accommodating of the pivot portion 101 into the through opening 105.

In the foregoing prior art shown in FIG. 13, the cam portion 104 provided on the side of the actuator 103 is located close to the position of contact beams 106 of the terminals 100. During assembly of the actuator 103, care must be taken to prevent the cam portion 104 from contacting and damaging contact beam 106. Lowering the profile of the connector reduces the distance between the contact beams of the terminals and the pivot beam to make the foregoing problem significant. Therefore, solving of the problem set forth above becomes a requirement for achieving lower profile connectors.

The opening dimension (A) of the through hole 105 of the actuator 103 is greater in comparison with the dimension in the height direction of the pivot portion 101 of the terminal 100. The actuator 103 which is in an open condition as shown in the drawings, is pivoted in the direction of arrow R to its closed condition to establish connection with the FPC. During this pivoting movement, the pivot portion 102 and the cam portion 104 can be disengaged allowing the actuator 103 to slide out of the connector without pivoting. Frontward sliding of the actuator 103 is prevented only by the engaging portion between the cam portion 104 and the pivot portion 102.

Furthermore, in the prior art shown in FIG. 13, all of the cam portions 104 are received within a cut-out portion of the pivot portion 102. On the other hand, the cam portion 104 urges the inserted FPC toward the contact beam 106 to contact under pressure to contact the contact of the contact beam 106 and the contact of the FPC (contacts on the lower surface in the shown case) to establish electrical connection. For this reason, in order to obtain sufficient strength in the pivot portion 102, a width in the height direction of the pivot beam 101 has to be sufficiently large. On the contrary to this, the width in the height direction of the pivot beam 101 has to be reduced for forming low profile connector. Therefore, in the support structure of the conventional actuator, freedom in designing of the connector is restricted.

SUMMARY OF THE INVENTION

The present invention has been worked out in view of the problem set forth above. Therefore, it is an object of the present invention to provide an FPC connector which has a structure not damaging contacts of terminals upon assembly.

Another object of the present invention is to provide an FPC connector which can prevent an actuator from sliding out of engagement during pivoting.

A further object of the present invention is to provide an FPC connector having a support structure for an actuator which can provide large freedom in designing a connector.

To achieve these and other objects, the present invention is a new FPC connector. This connector includes an insulative housing formed with an FPC insertion slot, a plurality of terminals loaded within the insulative housing in parallel relationship with a predetermined pitch, and a pivoting actuator for establishing contact between conductors of the FPC and of the terminals. Each of the terminals have a contact beam extending into the FPC insertion slot and a pivot beam extending substantially parallel in the upper side of the contact beam. A cut-out portion is formed on a lower edge at a tip end portion of the pivot beam for forming a pivot portion of the actuator. The actuator is formed with through openings corresponding to pivot portions of respective terminals. A peripheral edge portion of each of the through hole is formed into a cross-sectionally substantially circular shape shaft portion to engage with the pivot portion. Pushing projecting portions are provided between adjacent shaft portions and between the contact beams of the terminals which allow the actuator to pivot urging the FPC toward the contact beam of the terminals.

An opening dimension of each through hole formed in the actuator may be smaller than a dimension of the pivot portion of the terminal in height direction. The actuator may be pivotable between a first position where the actuator is oriented substantially parallel with the insulative housing and a second position where the actuator is oriented in a raised position, the actuator is engageable of the shaft portion with the pivot portion of the terminal only from lower side in the orientation of the actuator in the first position. The actuator may be supported by support members at both end portions of the insulative housing, and the shaft portion may be prevented from downward movement from the position engaging with the pivot portion.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other words, any well-known structure or feature is not shown in detail in order to avoid unnecessary obscurity of the present invention.

Figure 1:
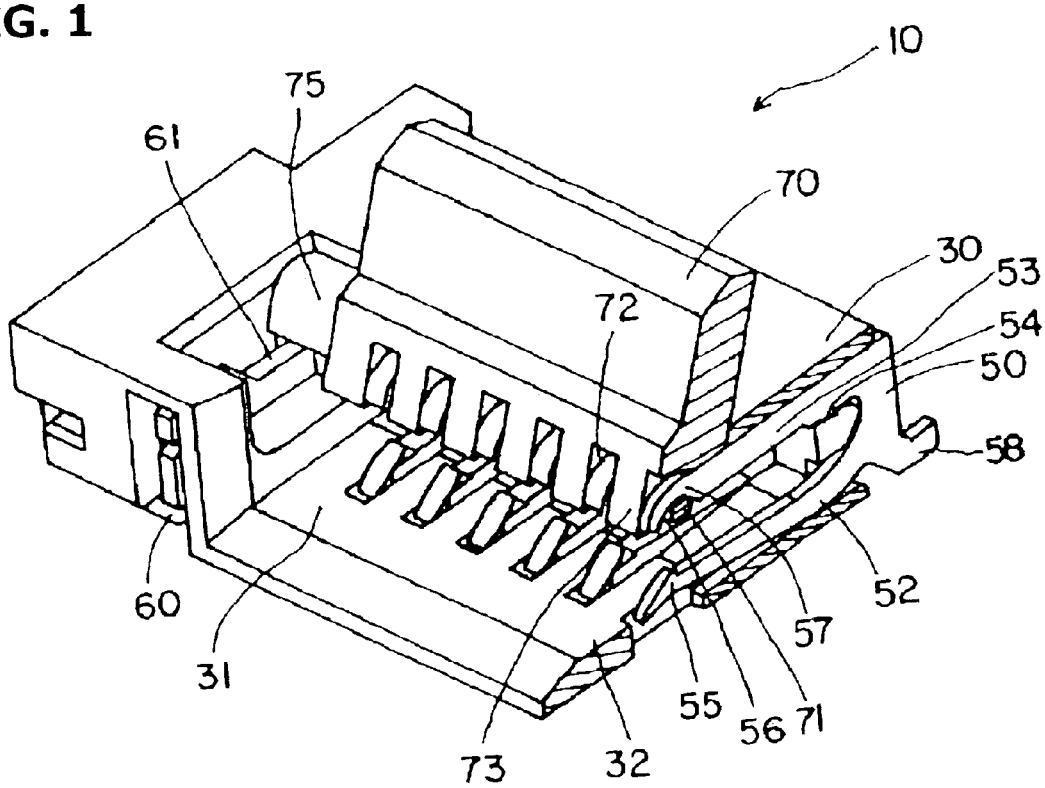
FIG. 1 is a partly cut out perspective view of the preferred embodiment of an FPC connector according to the present invention, which is illustrated in a condition where an actuator is placed at a second or open position.
Figure 2:
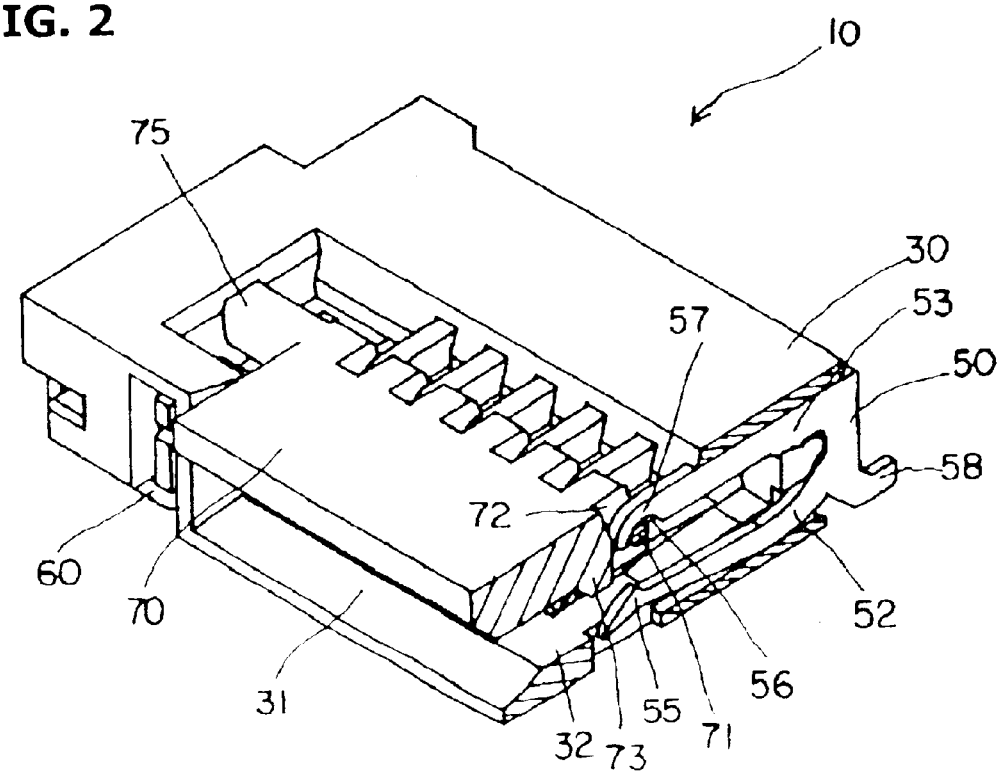
FIG. 2 is a partly cut out perspective view of the preferred embodiment of an FPC connector according to the present invention, which is illustrated in a condition where the actuator is placed at a first or closed position.

FIGS. 1 and 2 are perspective views showing the preferred embodiment of an FPC connector 10 according to the present invention. One end of the connector 10 is cut out. The shown embodiment of the FPC connector 10 includes an insulative housing 30, a plurality of terminals 50 and an actuator 70. The insulative housing 30 and the actuator 70 are molded from insulative plastic. The terminals 50 are formed by punching a thin metal plate.

The insulative housing 30 is provided with an FPC insertion slot 31 at the front portion (left front side in FIGS. 1 and 2 and left side in FIGS. 3 and 4) and is opened at the front end. A lower portion of the FPC insertion slot 31 is separated by a bottom plate 32. An upper portion of the FPC insertion slot 31 is designed to be opened and closed by an actuator 70.

The terminals 50 are arranged in side-by-side relationship with a predetermined pitch from rear end side of the insulative housing 30. Each terminal 50 has contact beam 52 and a pivot beam 53 extending from a base portion 51 in cantilever fashion. Upon installing in the insulative housing 30, the contact beam 52 extends along the bottom plate 32 in the lower portion of the FPC inserting portion 31. The pivot beam 53 extends along the upper side of the contact beam 52 in opposition thereto. The installed terminals 50 are fixed in the insulative housing 30 with the engaging portions 54 provided in the pivot beams 53 gripping the insulative housing 30.

On the upper edge of the tip end portion of the contact beam 52, is a projecting contact portion 55. The pivot beam 53 is provided with a cut-out portion 56 on the lower edge at the tip end to form a pivot portion 57 for the actuator 70. In the base portion of the terminal 50, a solder tail 58 is provided to extend rearwardly from the lower side. The solder tail 58 is thus placed substantially in flush with the bottom surface of the insulative housing 30 to surface mounting by soldering.

As set forth above, the actuator 70 is formed into a plate form so as to open and close the upper portion of the FPC insertion slot 31. In order to engage with the pivot portion 57 provided in the pivot beam 53 of the terminal, a sectionally circular shaft portion 71 is provided on one side edge of the actuator 70 at a position corresponding to the position of the pivot beam 53. The shaft portion 71 is formed by providing a through hole 72 corresponding to the pivot beam 53 on one side edge of the actuator 70. Between adjacent shaft portions 71 are pushing projecting portions 73. The pushing projecting portions 73 extend from the lower surface of the actuator 70. The pushing projecting portions 73 are located between adjacent pivot beams 53 of the terminals 50. Accordingly, the pushing projecting portions 73 are located between adjacent contact beams 52.

Figure 3:
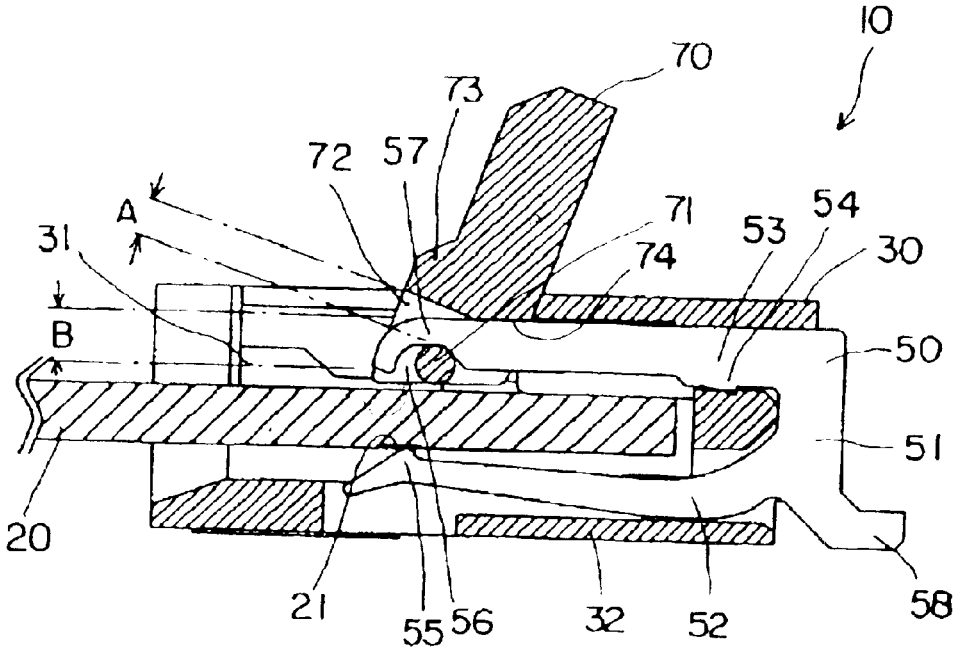
FIG. 3 is a side section of the preferred embodiment of an FPC connector according to the present invention of FIG. 1, which is illustrated in a condition where an actuator is placed at a second or open position.
Figure 4:
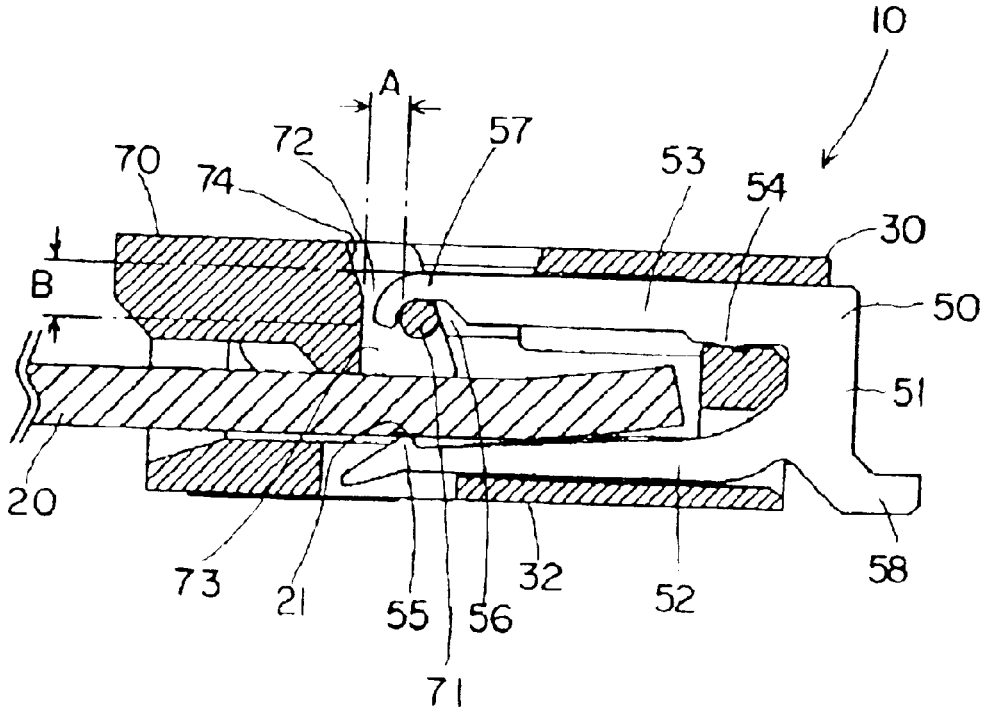
FIG. 4 is a side section of an FPC connector according to the present invention of FIG. 2, which is illustrated in a condition where the actuator is placed at a first or closed position.

By engaging the shaft portions 71 provided in the actuator 70 with the pivot portions 57 of the terminals 50, the actuator 70 is pivotable between a first or closed position where the actuator 70 is oriented substantially parallel to the insulative housing 30 to be horizontal as shown in FIGS. 2 and 4 and a second or open position where the actuator 70 is raised above the insulative housing 30 as shown in FIGS. 1 and 3. In the raised second position a tilted surface 74 is formed on the peripheral edge of the hole opposing to the shaft portion 71 of the through hole 72. The tilted surface 74 is in contact with the upper edge of the pivot beam 53. Accordingly, the actuator 70 pivoted to the second position can be held in place without requiring supporting by hand or the like.

The opening dimension A of each of the through hole 72 formed in the actuator 70 (see FIGS. 3 and 4) is made smaller than the dimension B in the height direction of the pivot portion 57 of the terminal 50 (see FIGS. 3 and 4). When the actuator 70 is operated for pivoting, and even if a component force is directed to the front of the insulative housing 30 acting on the actuator 70, the pivot portion 57 will never slide out from the through hole 72 by maintaining the shaft portion 71 within the cut-out portion 56 of the pivot portion. Accordingly, when the actuator 70 is pivoted from the second or open position to the first or closed position, the actuator 70 will never disengage from the pivot portion 57 of the terminal 50.

Figure 5:
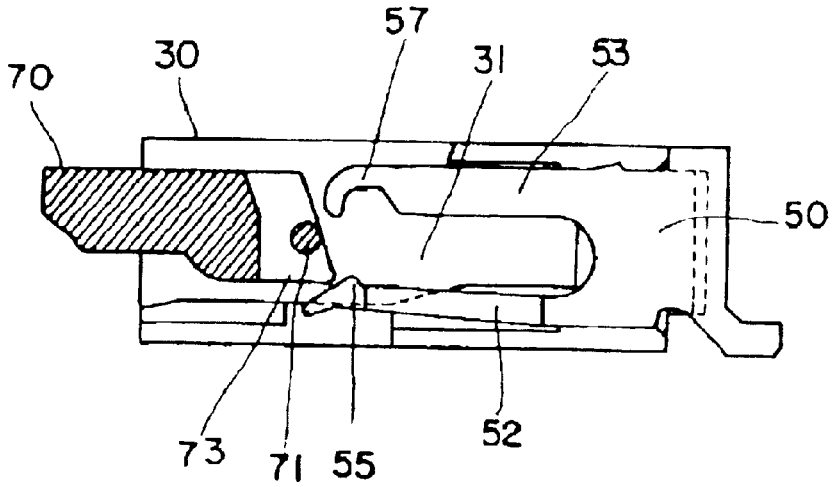
FIG. 5 is a side section showing the first step of the actuator when the actuator is arranged in opposition to an FPC insertion slot.
Figure 6:
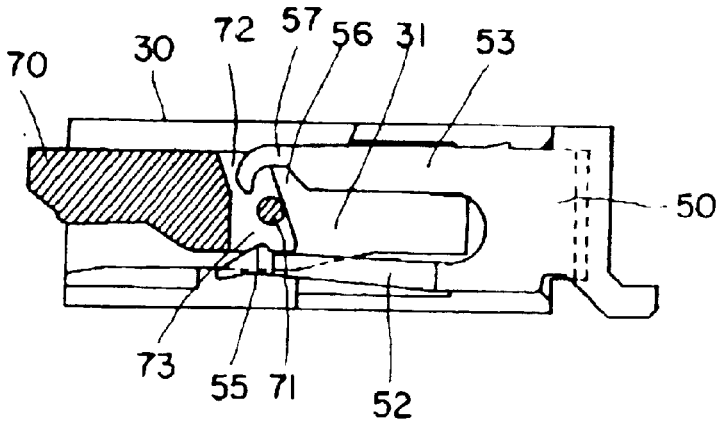
FIG. 6 is a side section showing the second step of assembling the actuator when the actuator is advanced from the condition shown in FIG. 5.
Figure 7:
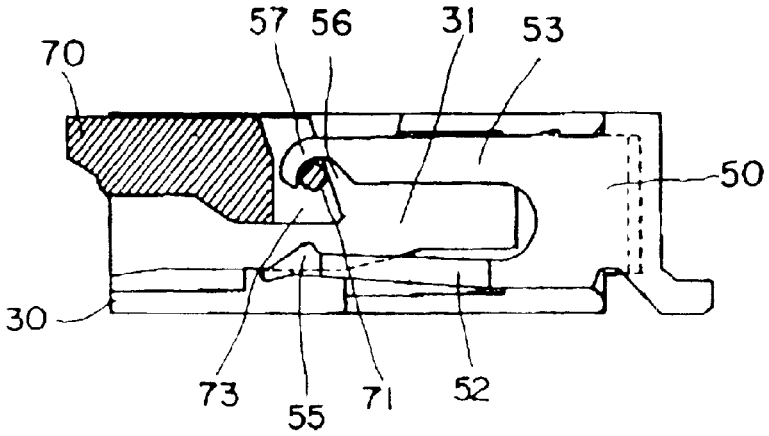
FIG. 7 is a side section showing the last step of assembling the actuator when the actuator is moved upward.

Since the opening dimension A of the through hole 72, between the inner edge of the hole 73 and the circumference of shaft 71, is made smaller than the dimension B in the height direction of the pivot portion 57, between the proximal tip end of pivot portion 57 and the circumference of shaft portion 71, assembling of the actuator 70 is performed by placing the shaft portion 71 below the pivot portion 57 and then moving the shaft portion 71 upward to engage with the pivot portion 57 as illustrated in FIGS. 5 to 7. As shown in FIG. 5, the actuator 70 is oriented in the first position (substantially horizontal orientation) to oppose to the FPC insertion slot 31. At this time, the shaft portion 71 is located below the pivot portion 57. Then, as shown in FIG. 6, the actuator 70 is horizontally moved in the direction of the FPC insertion slot 31 while maintaining the horizontal orientation for placing the shaft portion 71 below the cut-out portion 56 of the pivot portion 57. Finally, as shown in FIG. 7, the actuator 70 is moved upward to engage the shaft portion 71 and the pivot portion 57 so that the shaft portion 71 is received within the cut-out portion 56.

The actuator 70 thus assembled is provided with bosses 75 on both end portions (only boss 75 on one side is illustrated in FIGS. 1 and 2 for the purpose of illustration) for constantly maintaining the engaging condition of the shaft portion 71 and the pivot portion 57 and is supported by a support members 60 installed in both side portions of the insulative housing 30 from the front end face. On upper sides of supporting edges 61 formed in the support members 60, the bosses 75 are mounted so that the actuator 70 assembled at the predetermined position, may not be lowered.

Figure 8:
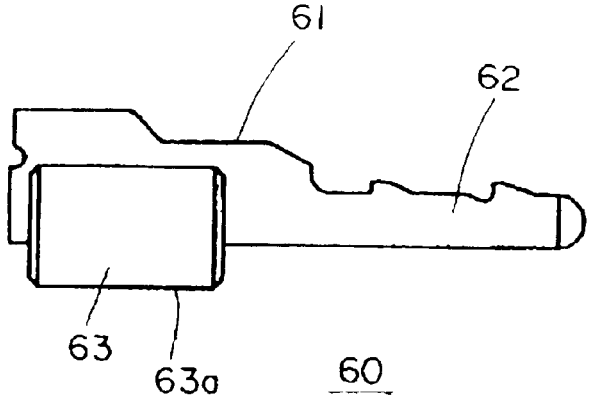
FIG. 8 is a front elevation of the support member.
Figure 9:
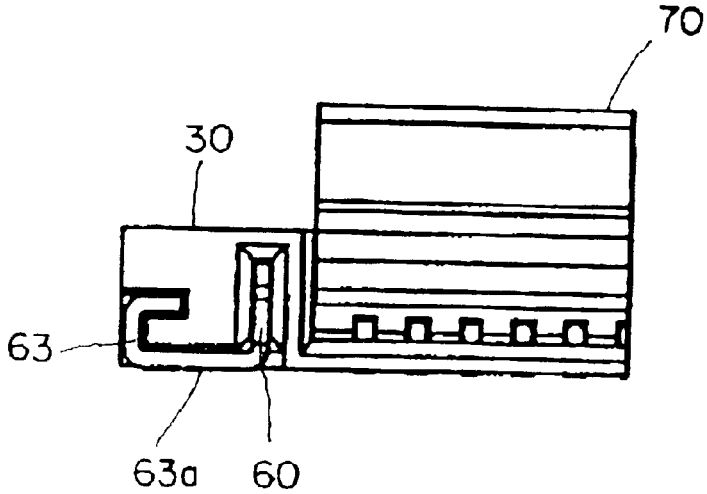
FIG. 9 is a partial front elevation of the FPC connector showing a installation slot of the support member.
Figure 10:
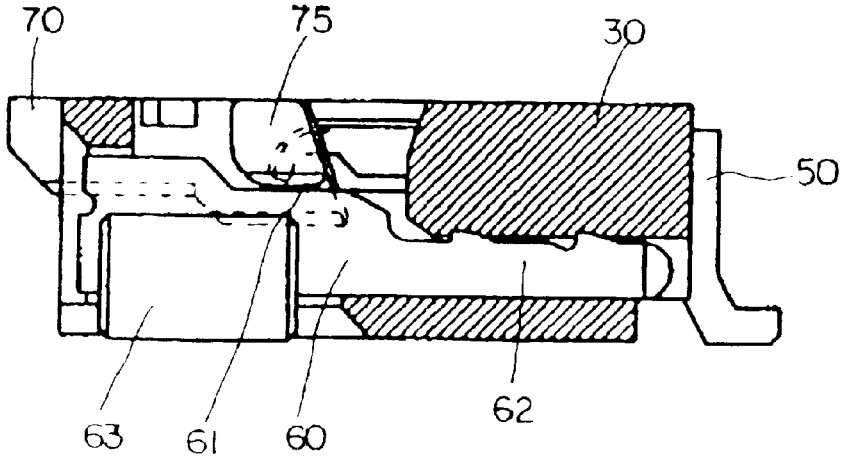
FIG. 10 is a side section showing a portion where a boss of the actuator is supported by the support member.

In FIG. 8, the support member 60 is illustrated. Similarly to the terminal 50, the support member 60 is punched from a thin metal plate. The support member 60 is formed with the support edge 61 for supporting the boss 75 of the actuator 70 at the intermediate portion. One boss 75 is located at each end of the actuator. An engaging portion 62 for engaging with the insulative housing 30 is provided at the front side thereof. The support member 60 is integrally formed with a fitting nail 63 on the base portion of one side. When the support member 60 is installed in the insulative housing 30, the fitting nail 63 is arranged in the side portion of the front portion of the insulative housing 30, as shown in FIG. 9. A soldering surface 63*a* is placed substantially flush with the bottom surface of the insulative housing 30. After the actuator 70 is assembled with the engaging the shaft portion 71 within the pivot portion 57 of the terminal 50, the support member 60 is installed on the insulative housing 30 for supporting the bosses 75 of the actuator 70 from downward movement on the support edge 61 to maintain engagement between the shaft portion 71 and the pivot portion 57, as shown in FIG. 10.

Figure 11:
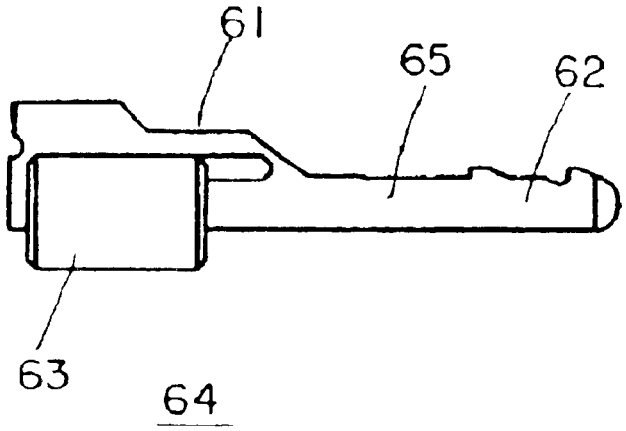
FIG. 11 is a front elevation of the support member of another embodiment.
Figure 12:
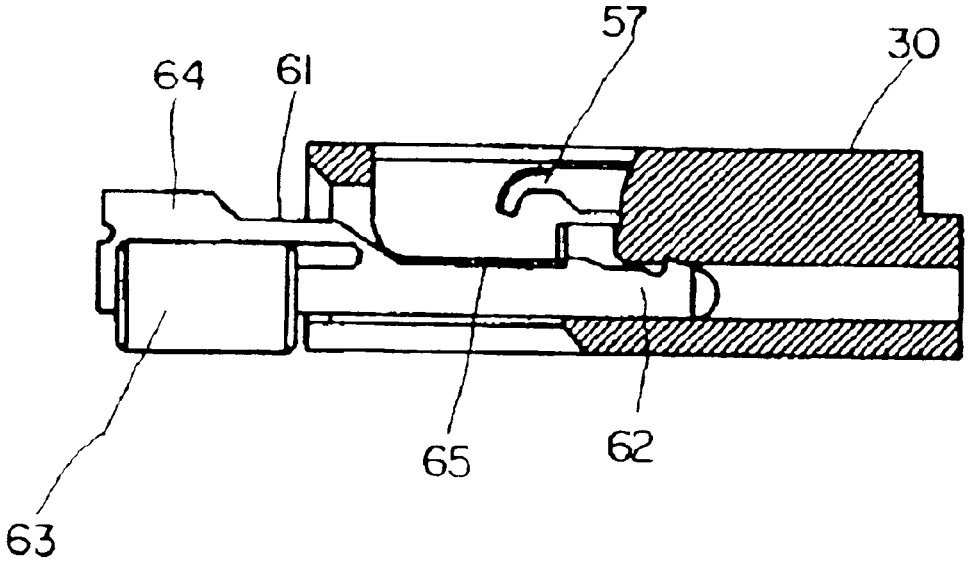
FIG. 12 is a side section showing a condition where another embodiment of the support member is temporarily installed.
Figure 13:
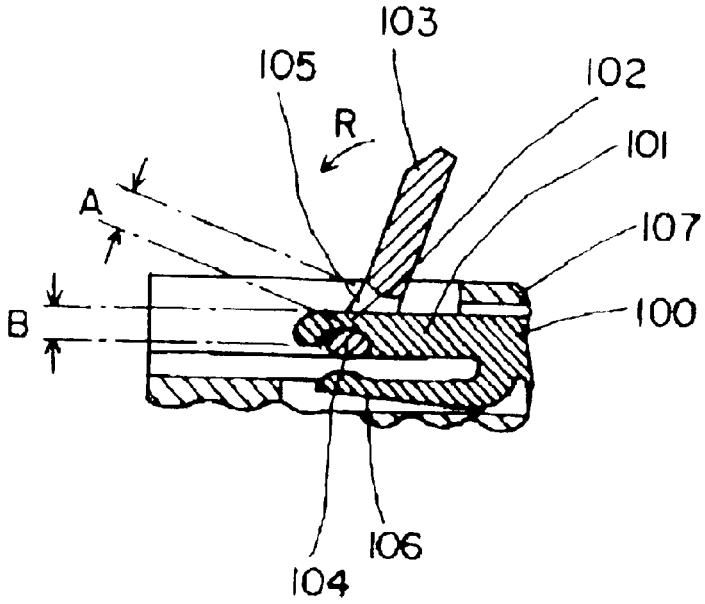
FIG. 13 is a side section of the conventional FPC connector in the prior art.
Figure 14:
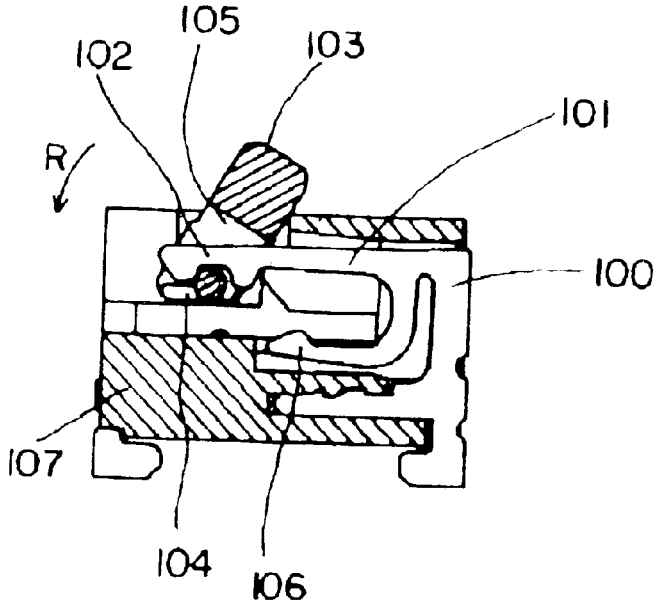
PRIOR ART FIG. 14
FIG. 14 is a section of another conventional FPC connector in the prior art.

The support member 60 of FIG. 8 installed after assembling of the actuator 70 can be replaced with a support member 64 of the shape as illustrated in FIG. 11. In the case of the support member 64, a lower edge portion 65 between the support edge 61 and the engaging portion 62 is provided. Before assembling the actuator 70, the support member 64 is temporarily installed as shown in FIG. 12. Thereafter, the actuator 70 is inserted. Subsequently, the support member 62 is installed at its first predetermined position.

Returning to FIGS. 3 and 4, the manner of connection of the FPC will be discussed. As shown in FIG. 3, the connection of the FPC 20 performed by placing the actuator 70 at the second position, inserting the end portion of the FPC 20 into the FPC inserting portion 31, and subsequently pivoting the actuator 70 in counterclockwise direction to the first position of FIG. 4. The actuator 70 is pivoted about the shaft portion 71 engaging with the pivot portion 57. During this pivoting movement, the pushing projecting portion 73 is also pivoted. The pushing projection portion 73 serves as a cam for urging the FPC 20 downward toward the contact beam 52. As a result, the contact beam 52 is elastically deformed and the projection contact 55 and the conductor 21 of the FPC are contacted with necessary contact pressure for establishing electrical connection. Thus, electrical connection can be established with high reliability.

As set forth above, the pushing projection portions 73 perform the cam action separately from the shaft portions 71 engaging with the pivot portions 57 of the terminals 50 between adjacent shaft portions 71. Upon assembling the actuator 70, the pushing projecting portions 73 are located between the adjacent terminals and not in line with the projecting contacts 55. As a result, upon assembling of the actuator 70, the pushing projecting portions 73 will not interfere with the contact beams 52 or the projecting contacts 55.

Upon connection of the FPC 20 and upon pivoting the assembled actuator 70, the component force on the actuator 70 is directed to release away from the pivot portions 57. However, since the opening dimension A of the through hole 72 is made smaller than the dimension B in the height direction of the pivot portion 57, the shaft portion 71 cannot easily slide out of the pivot portion 57 thereby preventing disengagement between the shaft portion 71 ands the pivot portion 57 during pivot motion of the actuator 70.

To provide some design freedom to the actuator, the shaft portion 71 is formed into a cross-sectionally circular shape and the pushing projecting portion 73 can be uniquely designed in consideration of the thickness of the FPC 20. Also, the pivot portion 57 of the terminal 50 can be formed to receive only the cut-out portion 56 for receiving the shaft portion 71 without being influenced by a shape of cam member (pushing projecting portion). Therefore, designing a low profile connector housing is facilitated.

As set forth above, with the present invention, since the actuator is constructed with the shaft portion engaging with the pivot portion and the pushing projecting portion performing cam action and formed separately from the pivot portion, upon assembling of the actuator, the pushing projecting portion does not interfere with the contact or the contact beam to facilitate assembling to permit efficient manufacturing of the FPC connector.

On the other hand, by designing the opening dimension of the through hole in the actuator to be smaller than the dimension in the height direction of the pivot portion, the actuator will never slide out from the pivot portion. As a result, connecting operation of the FPC can be assured.

In addition, where the shaft portion of the actuator and the pushing projecting portion are formed separately, there will be greater freedom in designing the actuator and the terminal. Therefore, the design of a low profile connector can be facilitated.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An FPC connector comprising:

an insulative housing formed with a flat printed circuit (FPC) insertion slot;

a plurality of terminals loaded within said insulative housing in parallel relationship with a predetermined pitch; and, an actuator pivotably provided for establishing contact between conductors of said FPC and said terminals, each of said terminals having a contact beam extending into said FPC insertion slot and a pivot beam extending substantially parallel in the upper side of said contact beam, a cut-out portion being formed on a lower edge at a tip end portion of said pivot beam for forming a pivot portion of said actuator, said actuator being formed with through holes corresponding to pivot portions of respective terminals, a peripheral edge poition of each of said through hele holes being formed into a cross-sectionally substantially circular shape shaft portion to engage with said pivot portion, and pushing projecting portions being provided between adjacent shaft portions and between said contact beams of the terminals for pivoting according to pivot motion of said actuator for engaging and urging said FPC toward said contact beams of said terminals.

2. An FPC connector as set forth in claim 1, wherein said pivot portion forms a hook shape and an opening dimension of each through holes defined between an inner edge of the through holes and an outer circumference of said shaft portion, located closest to the inner edge of the through hole, formed in said actuator is smaller than a dimension of said hook shaped pivot portion of said terminal in height direction defined between a proximal end of the hook shaped pivot portion and an upper horizontal portion of the pivot beam.

3. An FPC connector as set forth in claim 1, wherein said actuator is pivotable between a first position, where said actuator is oriented substantially parallel with said insulative housing, and a second position, where said actuator is oriented in a raised position, said shaft portion of said actuator is engageable with said pivot portion only when said actuator in said first position.

4. An FPC connector as set forth in claim 1, wherein said actuator has a boss at each end and each boss is supported from downward movement by support members held in both ends of said insulative housing, whereby said shaft portion is prevented from downward movement disengaging from said pivot portion.

* * * * *